US011798767B1

(12) United States Patent
Jie

(10) Patent No.: US 11,798,767 B1
(45) Date of Patent: Oct. 24, 2023

(54) ELECTRICAL OVERLOAD PROTECTION DEVICE AND METHOD OF USE

(71) Applicant: Lumi Legend Electrical Co. LTD, Ningbo (CN)

(72) Inventor: Xu Jie, Ningbo (CN)

( * ) Notice: Subject to any disclaimer, the term of this patent is extended or adjusted under 35 U.S.C. 154(b) by 0 days.

(21) Appl. No.: 17/744,190

(22) Filed: May 13, 2022

(51) Int. Cl.
*H01H 73/12* (2006.01)
*H01H 71/58* (2006.01)
*H01H 71/50* (2006.01)
*H01H 71/04* (2006.01)

(52) U.S. Cl.
CPC ..... *H01H 71/58* (2013.01); *H01H 71/04* (2013.01); *H01H 71/501* (2013.01); *H01H 2071/042* (2013.01)

(58) Field of Classification Search
CPC ..... H01H 71/58; H01H 71/04; H01H 71/501; H01H 2071/042
USPC ..... 335/18
See application file for complete search history.

(56) References Cited

U.S. PATENT DOCUMENTS 3,308,404 A * 3/1967 Fujita ..... H01H 71/503 335/174
3,373,383 A * 3/1968 Kasahara ..... H01H 71/142 335/18
3,451,016 A * 6/1969 Jakob ..... H01H 73/56 335/23
3,864,649 A * 2/1975 Doyle ..... H01R 13/7135 200/DIG. 42
3,970,975 A * 7/1976 Gryctko ..... H01H 71/04 335/17
4,037,185 A * 7/1977 Klein ..... H01H 83/226 361/115
4,282,500 A * 8/1981 Ducroquet ..... H01H 83/04 361/45
4,321,440 A * 3/1982 Fujiwara ..... H01H 71/503 200/324
4,382,270 A * 5/1983 Davidson ..... H01H 71/04 361/45
5,223,810 A * 6/1993 Van Haaren ..... H01H 71/58 335/18
5,517,165 A * 5/1996 Cook ..... H01H 83/12 361/42
7,911,298 B2 * 3/2011 Carlino ..... H01H 71/2463 335/172

(Continued)

*Primary Examiner* — Shawki S Ismail
*Assistant Examiner* — Lisa N Homza

(57) ABSTRACT

An electrical overload protection device for readily identifying and resetting a tripped circuit breaker includes a button, which is retained in depressed and extended configurations by a biaser. A first end and a second end of a plate spring are attached to the housing and the biaser, respectively. A bimetal strip, which is attached to and positioned in the housing, is reversibly deformable and thus bendable upon exposure to a specified current. Depressing the button contacts the biaser with the bimetal strip to complete an electrical circuit, which, should it exceed the specified current, bends the bimetal strip to actuate the plate spring to extend a shaft from the housing. The bending also disengages the biaser from the bimetal strip and breaks the electrical circuit. Depressing the shaft reverses deformation of the bimetal strip and reextends the button so it is again depressible to complete the electrical circuit.

13 Claims, 10 Drawing Sheets

(56) References Cited

U.S. PATENT DOCUMENTS

| | | | | |
|---|---|---|---|---|
| 2001/0022713 | A1* | 9/2001 | Gimenez | H01H 83/144<br>361/42 |
| 2002/0158726 | A1* | 10/2002 | Wellner | H01H 71/04<br>335/18 |
| 2005/0140489 | A1* | 6/2005 | Kuo | H01H 73/26<br>337/66 |
| 2009/0027154 | A1* | 1/2009 | Mills | H01H 71/04<br>337/101 |
| 2011/0297518 | A1* | 12/2011 | Baujan | H01H 71/7409<br>200/17 R |
| 2016/0005555 | A1* | 1/2016 | Najera | H01H 71/2454<br>335/43 |
| 2023/0041691 | A1* | 2/2023 | Huang | H01H 71/526 |

* cited by examiner

ELECTRICAL OVERLOAD PROTECTION DEVICE AND METHOD OF USE

(a) TITLE OF THE INVENTION

ELECTRICAL OVERLOAD PROTECTION DEVICE AND METHOD OF USE

(b) CROSS-REFERENCE TO RELATED APPLICATIONS

Not Applicable

(c) STATEMENT REGARDING FEDERALLY SPONSORED RESEARCH OR DEVELOPMENT

Not Applicable

(d) THE NAMES OF THE PARTIES TO A JOINT RESEARCH AGREEMENT

Not Applicable

(e) INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

(f) STATEMENT REGARDING PRIOR DISCLOSURES BY THE INVENTOR OR JOINT INVENTOR

Not Applicable

(g) BACKGROUND OF THE INVENTION

(1) Field of the Invention

The disclosure relates to circuit breakers and more particularly pertains to a new circuit breaker for readily identifying and resetting a tripped circuit breaker. The present invention discloses a circuit breaker having a readily viewable shaft that extends from a housing upon tripping of the circuit breaker. The shaft is depressed to reset the circuit breaker.

(2) Description of Related Art including information disclosed under 37 CFR 1.97 and 1.98.

The prior art relates to circuit breakers, which generally comprise toggles that are switched upon exposure of attached plates to a specified current. One deficiency of prior art circuit breakers is that a position of the toggle with the circuit breaker tripped configuration is not readily visually discernable from a position of the toggle with the circuit breaker not being tripped. What is lacking in the prior art is a circuit breaker comprising a shaft that extends from a housing upon exposure of the circuit breaker to a specified current, causing the circuit breaker to trip. The shaft then is readily visible and indicates that the circuit breaker has been tripped. Simply depressing the shaft resets the circuit breaker.

(h) BRIEF SUMMARY OF THE INVENTION

An embodiment of the disclosure meets the needs presented above by generally comprising a housing, which defines an interior space. A button, which is selectively depressible, is attached to an upper facet of the housing. A biaser is attached to the housing and is operationally engaged to the button to selectively retain the button in a depressed configuration and an extended configuration. A shaft is slidably attached to the housing and is selectively extendible from the upper facet of the housing. A first end and a second end of a plate spring are attached to the housing and the biaser, respectively. A bimetal strip is attached to the housing and is positioned in the interior space. The bimetal strip is reversibly deformable and is configured to bend upon exposure to a specified current. The button is configured to be depressed to induce electrical contact of the biaser with the bimetal strip, which completes an electrical circuit. Upon exposure to the specified current, the bimetal strip bends and actuates the plate spring to extend the shaft from the upper facet and to disengage the biaser from the bimetal strip, thereby breaking the electrical circuit. A user then is positioned to depress the shaft to reverse deformation of the bimetal strip and to actuate the biaser to extend the button to the extended configuration. The button then is again depressible to complete the electrical circuit.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

(i) BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

(j) DETAILED DESCRIPTION OF THE INVENTION

Figure 1:
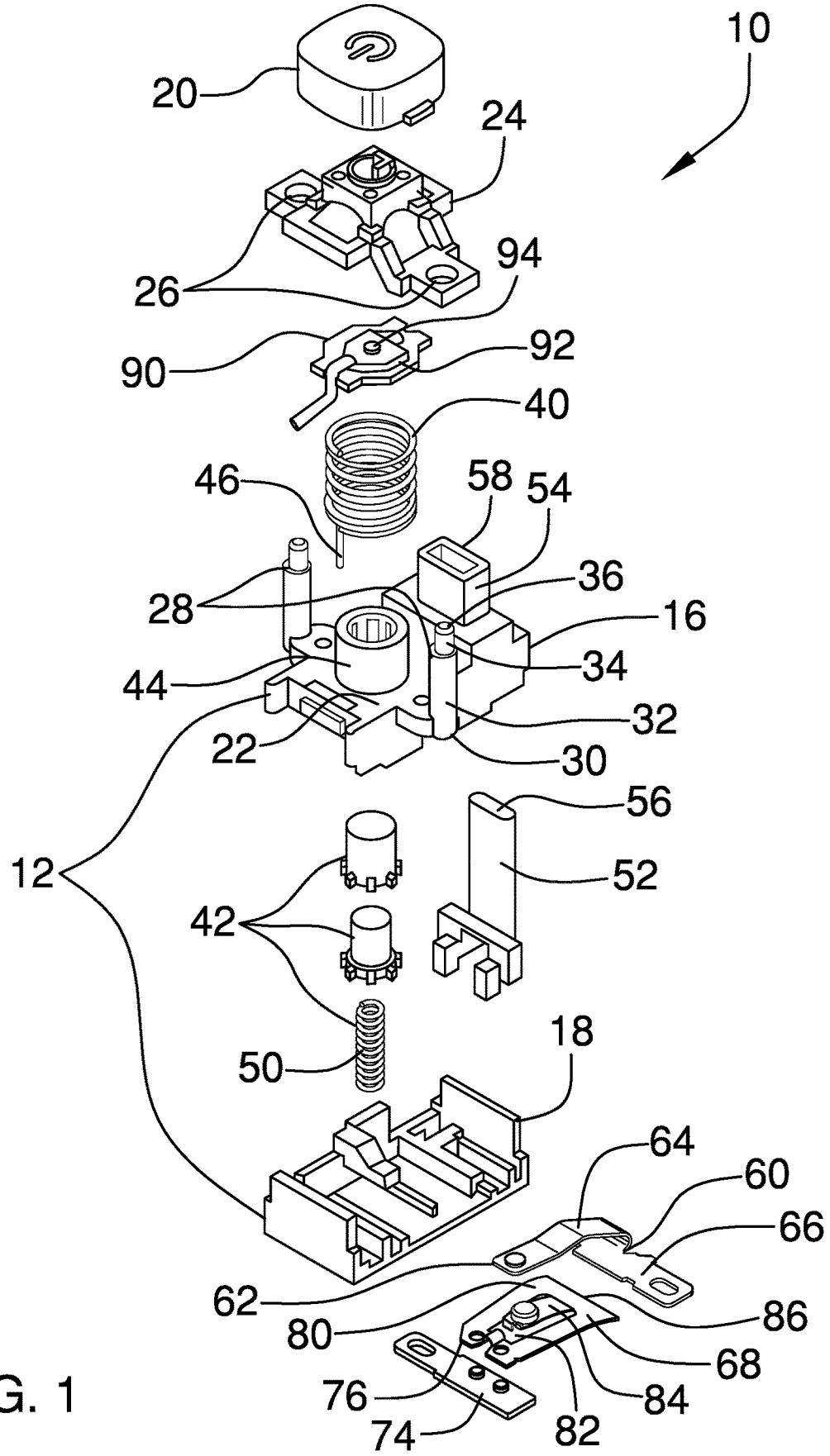
FIG. 1 is an exploded view of an electrical overload protection device according to an embodiment of the disclosure.

With reference now to the drawings, and in particular to FIGS. 1 through 16 thereof, a new circuit breaker embodying the principles and concepts of an embodiment of the disclosure and generally designated by the reference numeral 10 will be described.

As best illustrated in FIGS. 1 through 16, the electrical overload protection device 10 generally comprises a housing 12, which defines an interior space 14. As is shown in FIG. 1, the housing 12 comprises an upper piece 16, which is selectively attachable to a lower piece 18 to facilitate construction of the electrical overload protection device 10.

Figure 2:
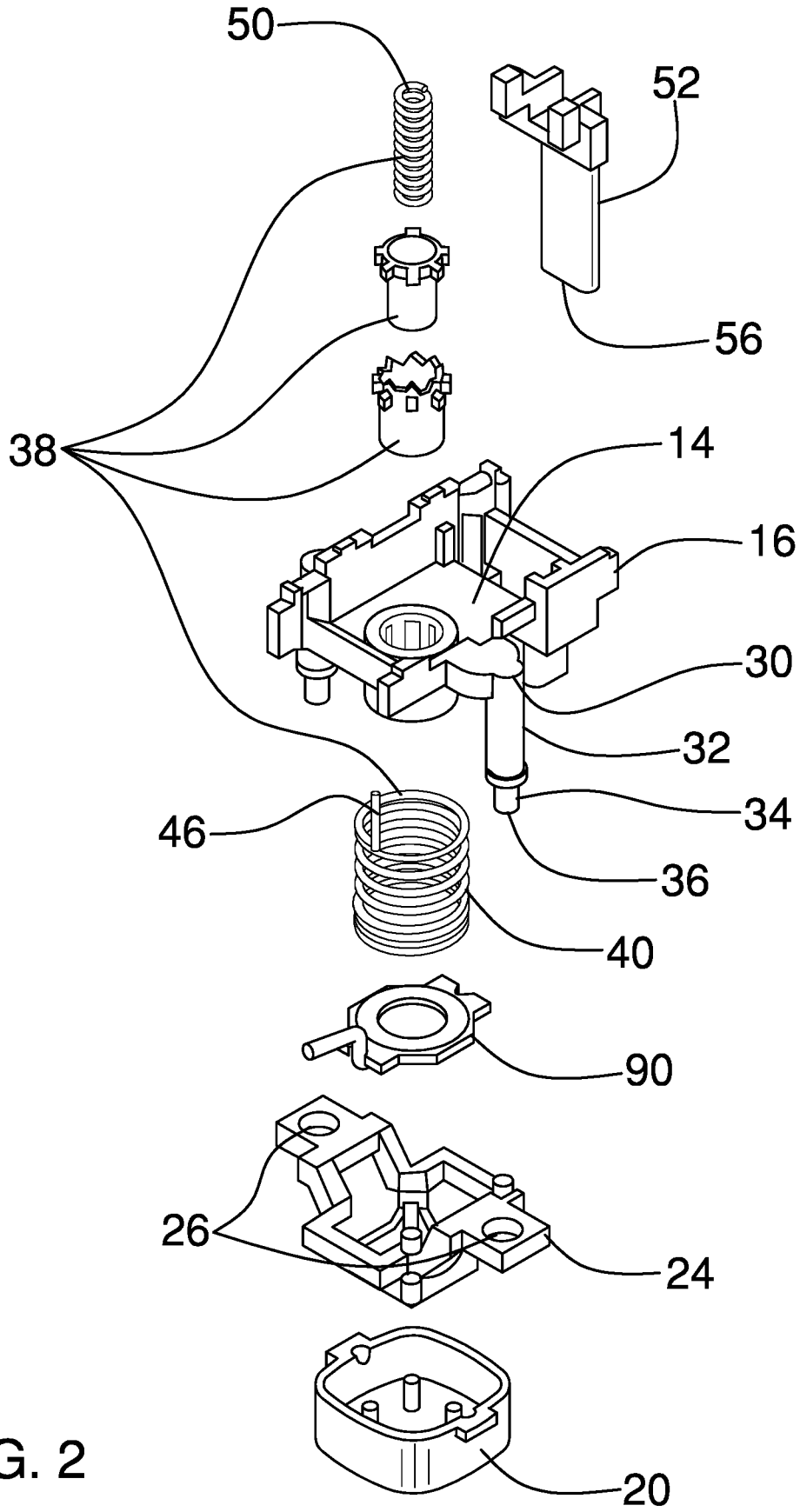
FIG. 2 is an exploded view of an embodiment of the disclosure.
Figure 3:
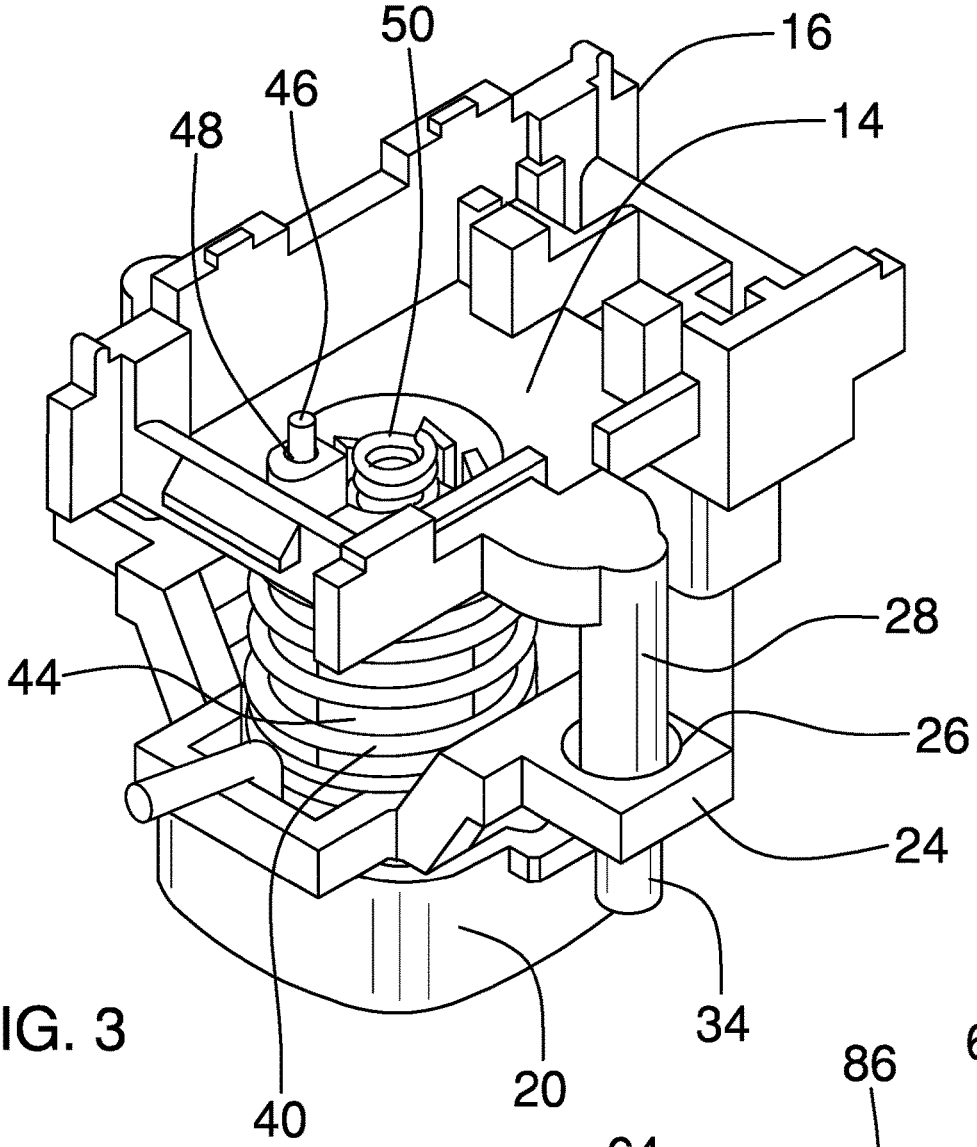
FIG. 3 is a bottom view of an embodiment of the disclosure.
Figure 4:
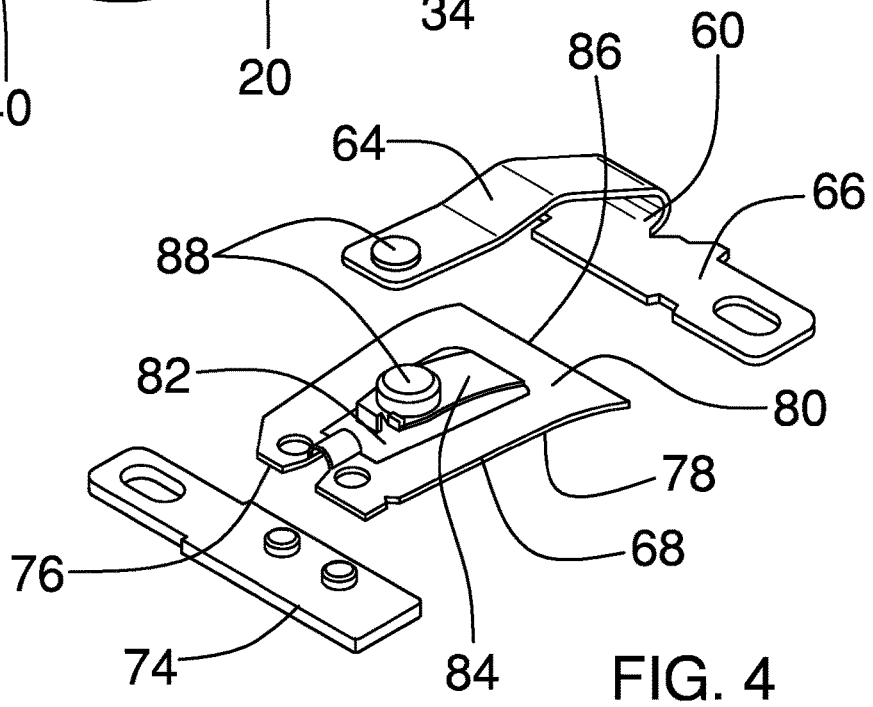
FIG. 4 is a detail view of an embodiment of the disclosure.
Figure 5:
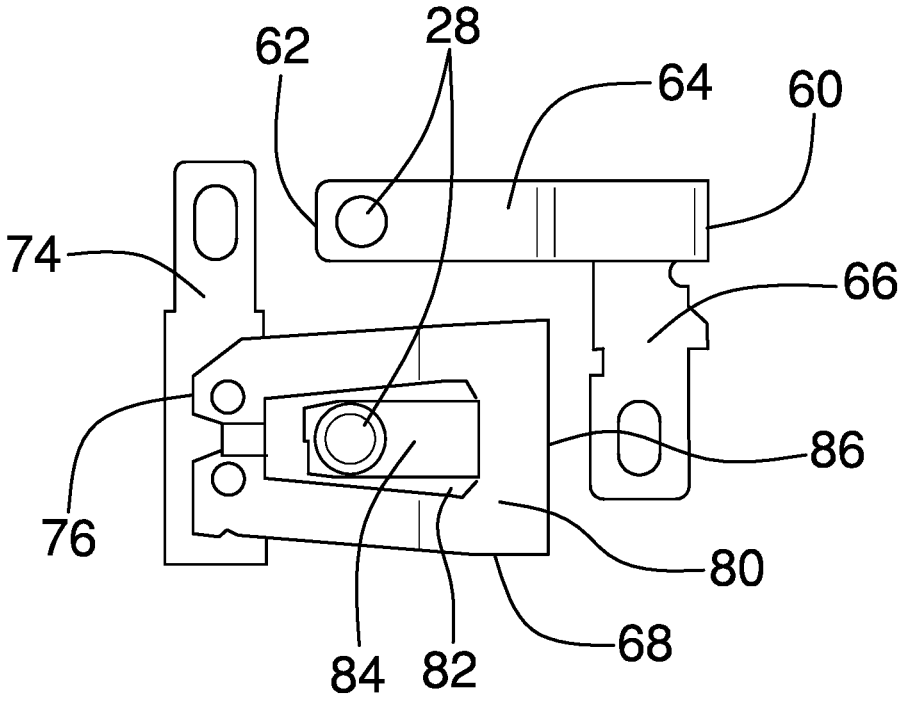
FIG. 5 is a top detail view of an embodiment of the disclosure.
Figure 6:
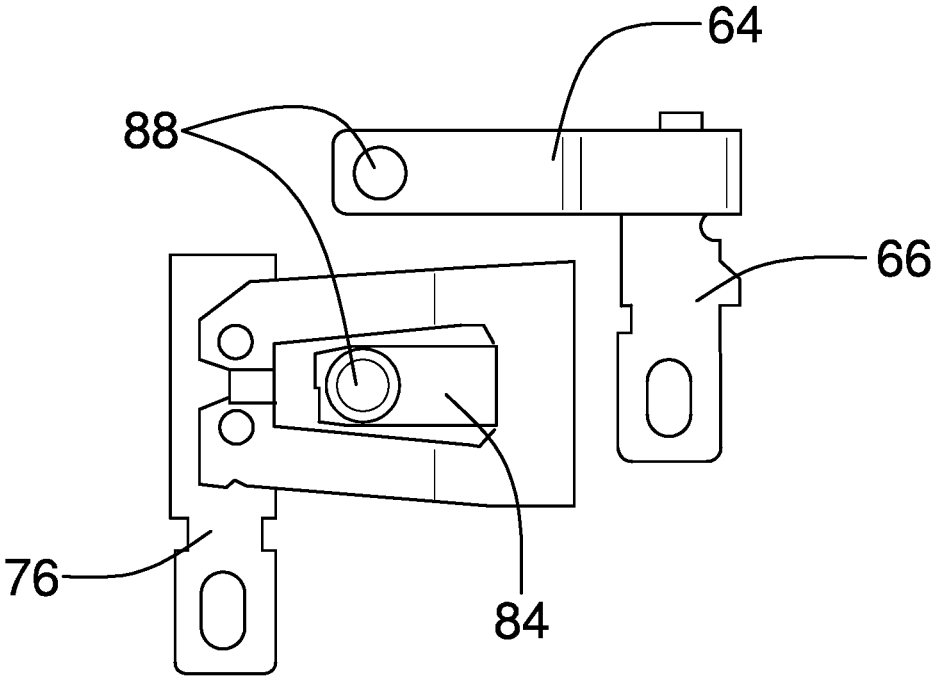
FIG. 6 is a top detail view of an embodiment of the disclosure.
Figure 7:
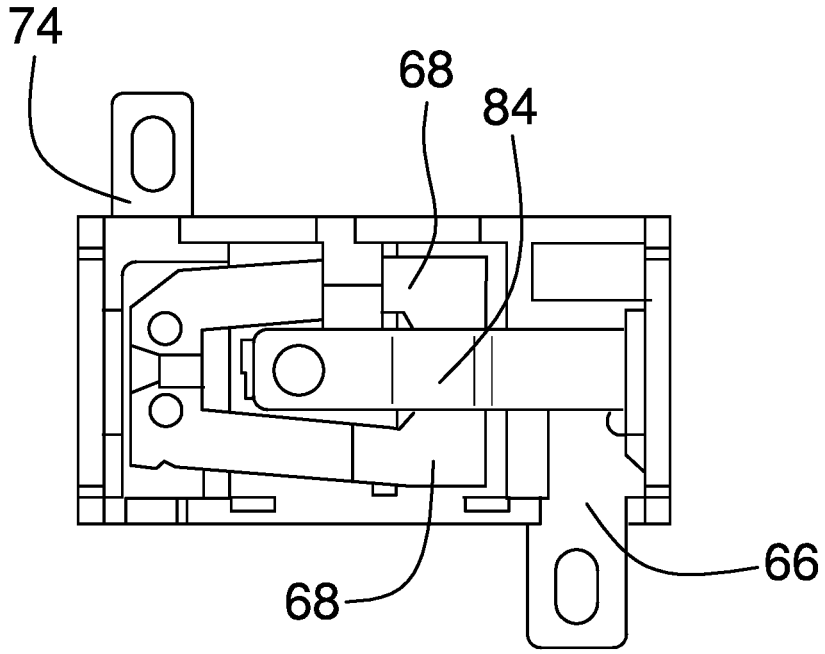
FIG. 7 is a top detail view of an embodiment of the disclosure.
Figure 8:
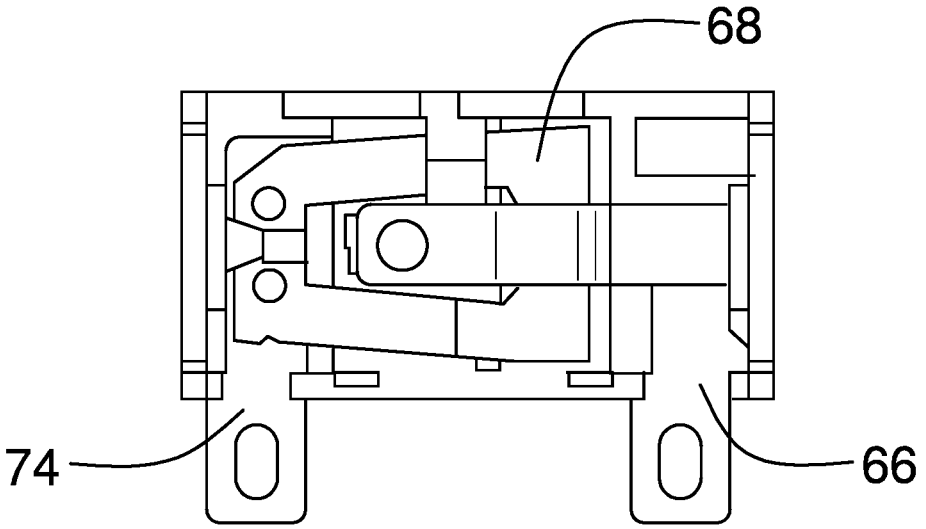
FIG. 8 is a top detail view of an embodiment of the disclosure.
Figure 9:
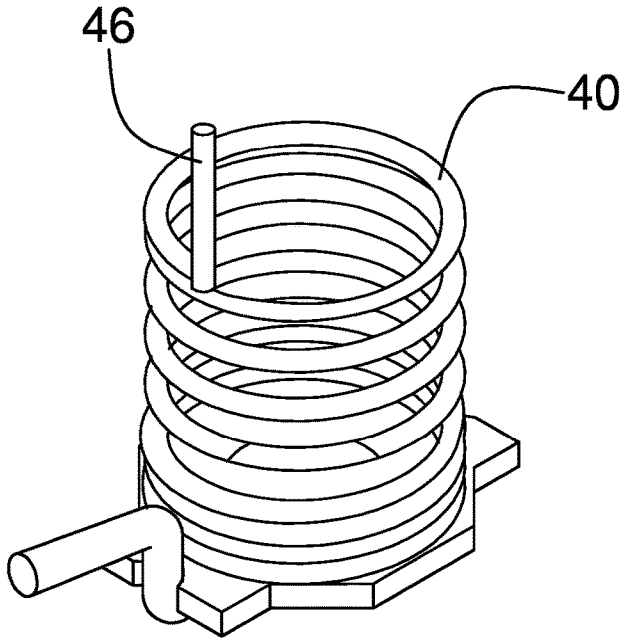
FIG. 9 is a detail view of an embodiment of the disclosure.
Figure 10:
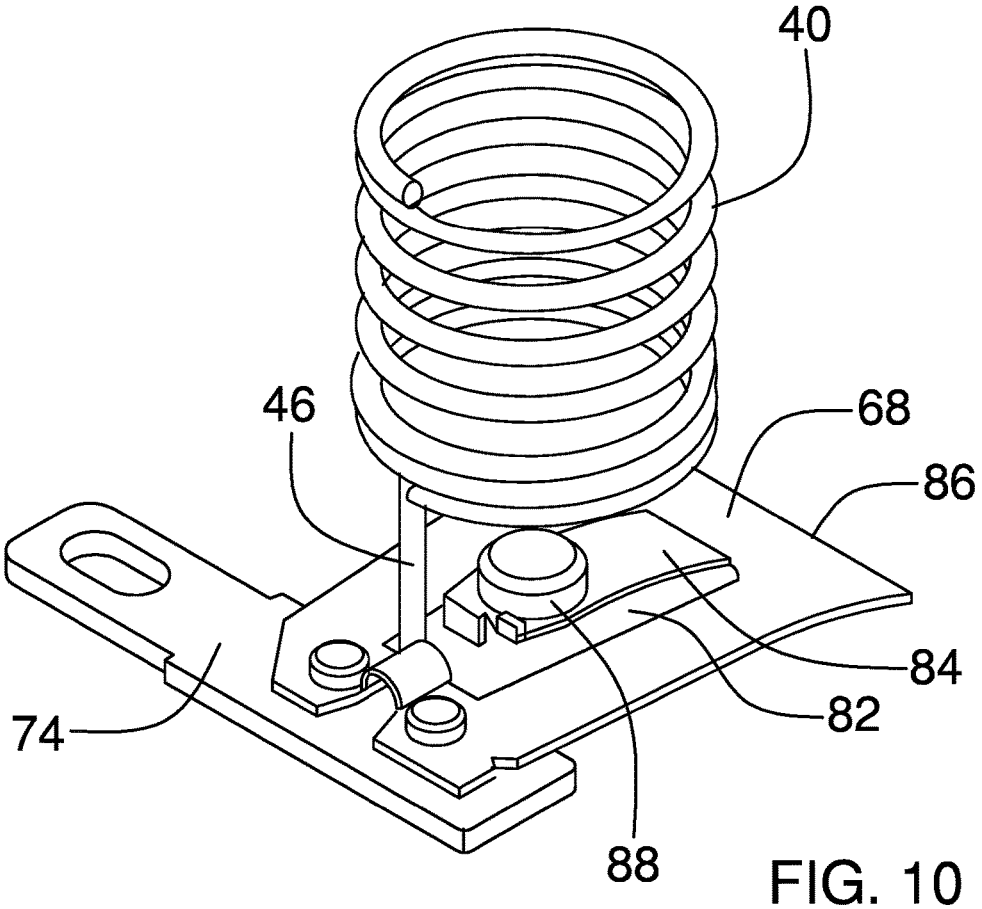
FIG. 10 is a detail view of an embodiment of the disclosure.

A button 20, which is selectively depressible, is attached to an upper facet 22 of the housing 12. The button 20 is cup shaped and translucent. The button 20 is attached to a bracket 24, in which a pair of guide holes 26 is positioned, as is shown in FIG. 2. Each of a pair of posts 28 is attached by its first terminus 30 to, and extends from, the upper facet 22 of housing 12. A first segment 32 of the post 28, which is adjacent to the housing 12, is circumferentially larger than a second segment 34, which is adjacent to a second terminus 36 of the post 28. The guide holes 26 are complementary to the second segments 34 of the posts 28 so that each guide hole 26 is positioned for insertion of a respective second segment 34. Depression of the button 20 is limited by contacting of the bracket 24 with the first segments 32 of the posts 28. This configuration stabilizes the button 20 as it is pressed.

Figure 11:
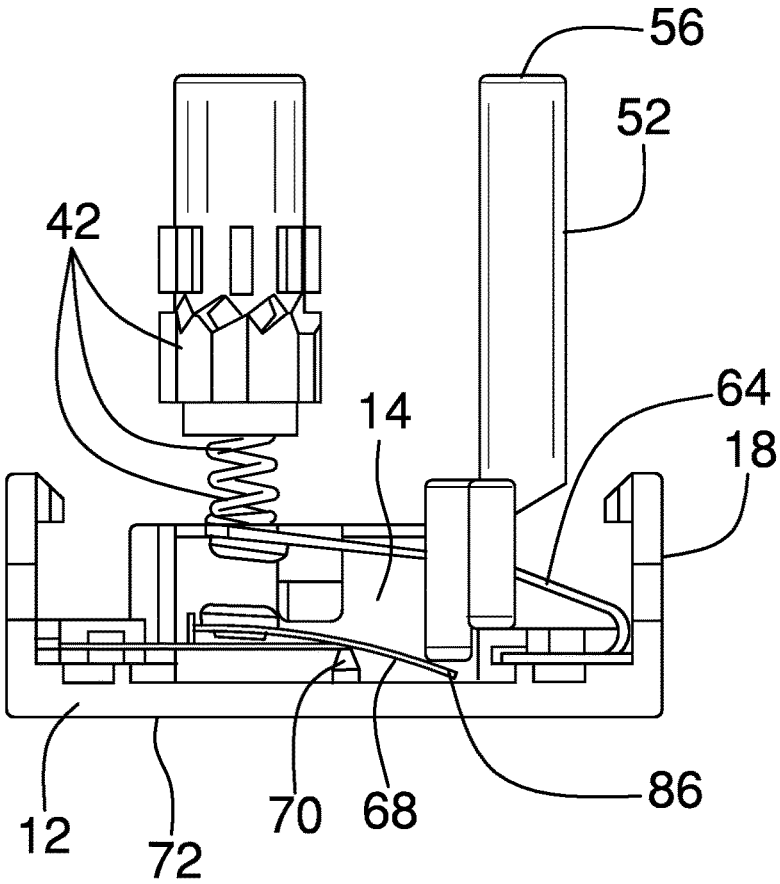
FIG. 11 is a side, unengaged, view of an embodiment of the disclosure.
Figure 12:
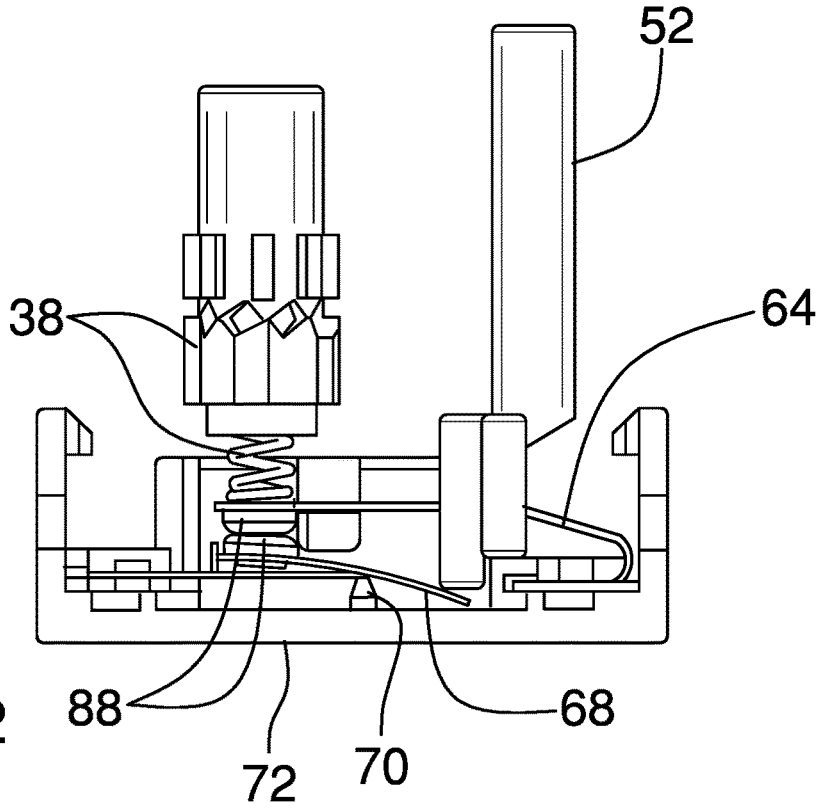
FIG. 12 is a side, engaged, view of an embodiment of the disclosure.
Figure 13:
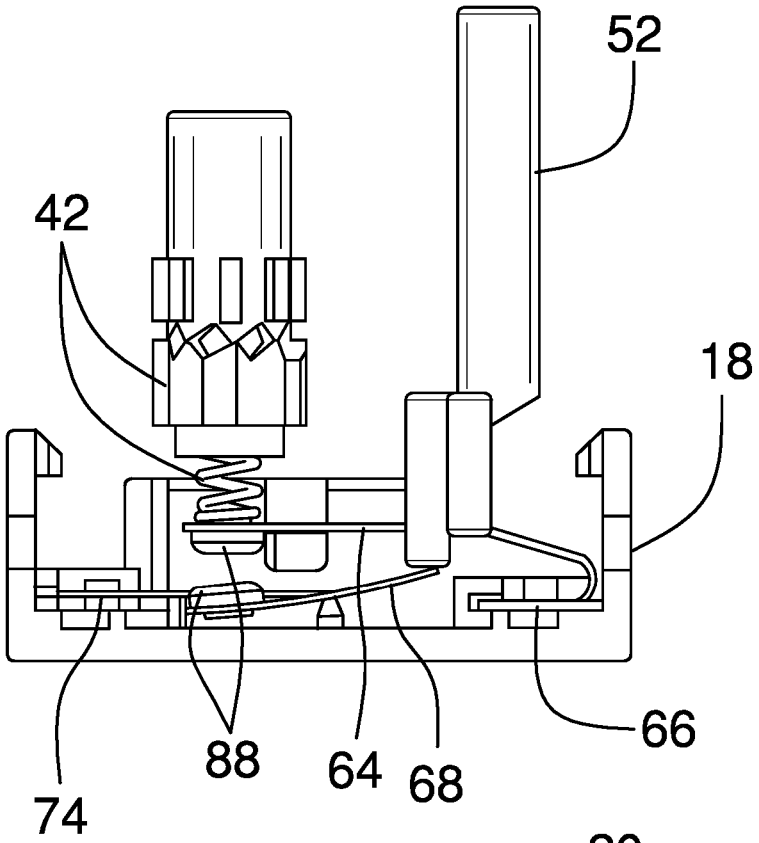
FIG. 13 is a side, tripped, view of an embodiment of the disclosure.
Figure 14:
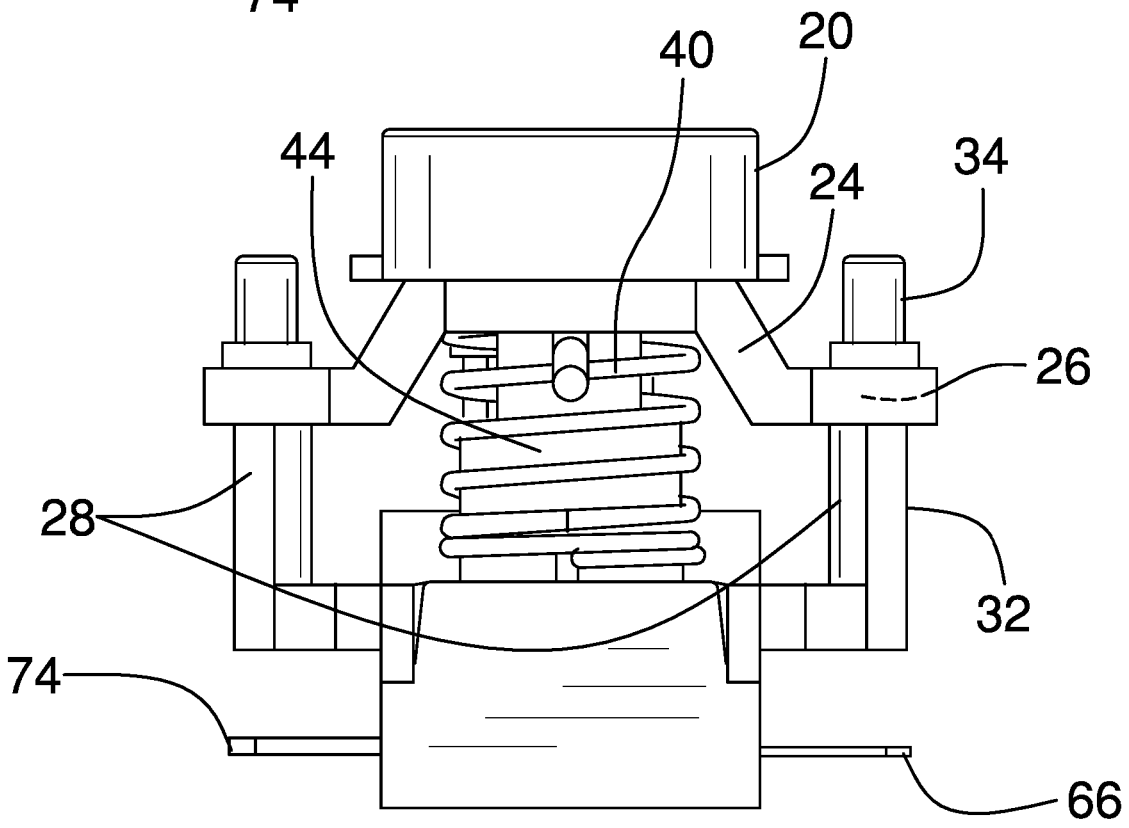
FIG. 14 is a detail view of an embodiment of the disclosure.

A biaser 38 is attached to the housing 12 and is operationally engaged to the button 20. The biaser 38 selectively retains the button 20 in a depressed configuration and an extended configuration, as is shown in FIGS. 12 and 11, respectively. The biaser 38 comprises a reset spring 40 and a ratchet switch 42. The reset spring 40 is positioned around a cylinder 44, which is attached to the upper facet 22 of the housing 12. The cylinder 44 is hollow and in fluidic communication with the interior space 14. A terminal segment 46 of the reset spring 40 extends through a connecting hole 48, which is positioned in the housing 12, and into the interior space 14. The ratchet switch 42 is positioned in the cylinder 44. A ratchet spring 50 of the ratchet switch 42 extends into the interior space 14.

Figure 15:
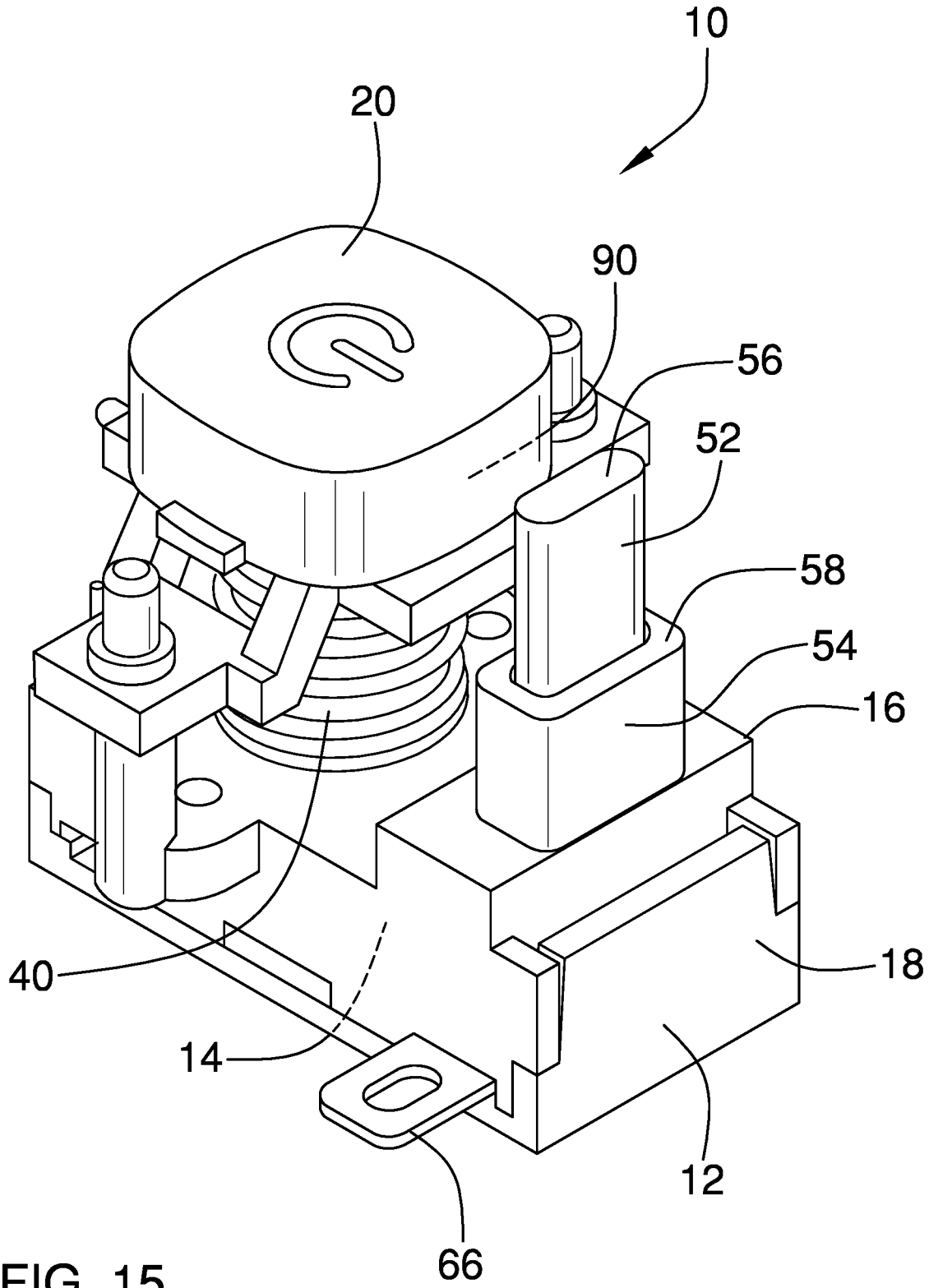
FIG. 15 is an isometric perspective, tripped, view of an embodiment of the disclosure.

A shaft 52 is slidably attached to the housing 12 and is selectively extendible from the upper facet 22 of the housing 12. A pipe 54 is attached to and extends from the upper facet 22 of the housing 12. The pipe 54 is in fluidic communication with the interior space 14. The shaft 52 is positioned in the pipe 54 so that an upper end 56 of the shaft 52 is substantially flush with a top 58 of the pipe 54 when the shaft 52 is in a depressed position. The shaft 52 is brightly colored and thus is readily visible when in an extended position, as is shown in FIG. 15.

A first end 60 and a second end 62 of a plate spring 64 are attached to the housing 12 and the biaser 38, respectively. A first connecting element 66 is attached to the housing 12 and to the plate spring 64. A bimetal strip 68 is attached to the housing 12 and is positioned in the interior space 14. A wedge 70 is attached to a bottom 72 of the housing 12 and extends into the interior space 14. The wedge 70 contacts the bimetal strip 68 to enhance electrical contact between the bimetal strip 68 and the biaser 38. A second connecting element 74 is attached to the housing 12 and to a first edge 76 of the bimetal strip 68. As is shown in FIGS. 5 and 6, and again in FIGS. 7 and 8, the second connecting element 74 can be flipped 180° to provide flexibility in making connections to an electrical circuit.

The bimetal strip 68 is reversibly deformable and is configured to bend upon exposure to a specified current. The bimetal strip 68 comprises a bottom layer 78, which comprises active metal, and a top layer 80, which comprises passive metal. A cutout 82 is positioned in the bimetal strip 68 and defines an extension 84, which extends angularly from the bimetal strip 68 over the cutout 82 so that the extension 84 and is positioned to contact the ratchet spring 50.

An expansion coefficient of the bottom layer 78 of the bimetal strip 68 is greater than that of the top layer 80. Thus, when the bimetal strip 68 is overloaded, a second edge 86 of the bimetal strip 68 is bent from the bottom layer 78 to the top layer 80, and the extension 84 passes through the cutout 82 and away from the biaser 38. As will be shown below, the extension 84 disengaging from the biaser 38 breaks an electrical circuit, effectively "tripping" the electrical overload protection device 10.

Each of a plurality of connectors 88 is attached to a respective one of the first connecting element 66, the second connecting element 74, the ratchet spring 50, and the extension 84, to enhance electric connections therebetween.

An illumination module 90 is positioned between the reset spring 40 and the bracket 24. The illumination module 90 is in electrical contact with the reset spring 40 and is powered when the terminal segment 46 is in electrical contact with the bimetal strip 68. The illumination module 90 is configured to illuminate the button 20, upon depressing of the button 20, until the bimetal strip 68 is exposed to the specified current. An advantage of this configuration is that no wiring is required to supply power to the illumination module 90. The illumination module 90 may comprise a Printed Circuit Board (PCB) 92 and a light emitting diode 94. Using a PCB 92 in the illumination module 90 is convenient, efficient, in that manufacturing is greatly simplified, reduces costs by eliminating parts and welds, provides stability, and reduces a risk of bad contacts and broken circuits within the illumination module 90.

The button 20 is configured to be depressed to induce electrical contact of the biaser 38 with the bimetal strip 68, which completes the electrical circuit. Upon exposure to the specified current, the bimetal strip 68 bends and actuates the plate spring 64 to extend the shaft 52 from the upper facet 22 and to disengage the biaser 38 from the bimetal strip 68, thereby breaking the electrical circuit. A user then is positioned to depress the shaft 52 to reverse deformation of the bimetal strip 68 and to actuate the biaser 38 to extend the button 20 to the extended configuration. The button 20 then is again depressible to complete the electrical circuit.

Figure 16:
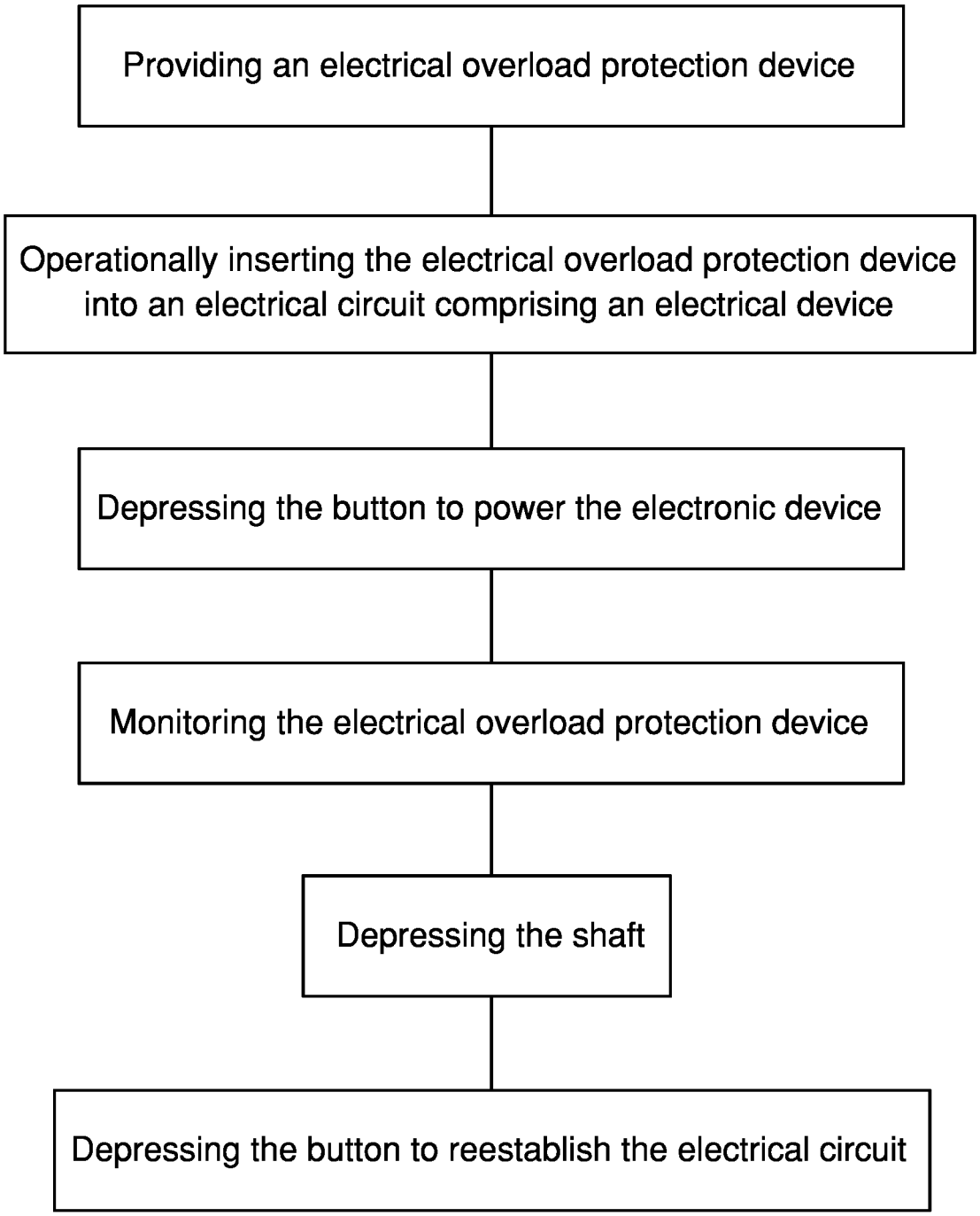
FIG. 16 is a flow diagram for a method utilizing an embodiment of the disclosure.

In use, the electrical overload protection device 10 enables a method of protecting an electronic device from damage due to an electrical overload. A flow diagram for the method is shown in FIG. 16. The method comprises a first step of providing an electrical overload protection device 10 according to the specification above. A second step of the method is operationally inserting the electrical overload protection device 10, using the first connecting element 66 and the second connecting element 74, into an electrical circuit comprising an electrical device (not shown). A third step of the method is depressing the button 20 to complete the electrical circuit to power the electronic device. In event of an overload, the bending of the bimetal strip 68 causes the electrical circuit to break and the shaft 52 to rise from the pipe 54. The electrical device thus is protected from damage.

A fourth step of the method is monitoring the electrical overload protection device 10 for rising of the shaft 52 from the pipe 54. The shaft 52, being elevated and brightly colored, clearly indicates that the electrical overload protection device 10 has been tripped. Tripping of the electrical overload protection device 10 leads to a fifth step of the method, which is depressing the shaft 52 to reverse deformation of the bimetal strip 68 and to reset the button 20. A sixth step of the method is depressing the button 20 again to reestablish the electrical circuit and to resupply power to the electronic device.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An electrical overload protection device comprising:

a housing defining an interior space;

a button attached to an upper facet of the housing, the button being selectively depressible;

a biaser attached to the housing and operationally engaged to the button, such that the biaser selectively retains the button in a depressed configuration and an extended configuration;

a shaft slidably attached to the housing and selectively extendible from the upper facet of the housing, such that the shaft is selectively positionable in a depressed position and an extended position;

a plate spring having a first end attached to the housing and a second end attached to the biaser; and a bimetal strip attached to the housing and positioned in the interior space, the bimetal strip is reversibly deformable and configured for bending upon exposure to a specified current, wherein the button is configured for depressing for inducing electrical contact of the biaser with the bimetal strip for completing an electrical circuit, such that, upon exposure to the specified current, the bimetal strip bends and actuates the plate spring for extending the shaft from the upper facet and for disengaging the biaser from the bimetal strip for breaking the electrical circuit, positioning a user for depressing the shaft for reversing deformation of the bimetal strip and for actuating the biaser for extending the button to the extended configuration, such that the button is again depressible for completing the electrical circuit.

2. The electrical overload protection device of claim 1, wherein the housing comprising an upper piece selectively attachable to a lower piece.

3. The electrical overload protection device of claim 1, further including:

a pair of posts, each post being attached by a first terminus to and extending from the upper facet of housing, a first segment of the post adjacent to the housing being circumferentially larger than of a second segment adjacent to a second terminus of the post;

a bracket, the button being attached to the bracket; and a pair of guide holes positioned is the bracket, the guide holes being complementary to the second segments of the posts, such that each guide hole is positioned for insertion of a respective second segment, such that depression of the button is limited by contacting of the bracket with the first segments of the posts.

4. The electrical overload protection device of claim 1, further including:

a cylinder attached to the upper facet of the housing, the cylinder being hollow and in fluidic communication with the interior space; and the biaser comprising:

a reset spring positioned around the cylinder, a terminal segment of the reset spring extending through a connecting hole in the housing into the interior space, and a ratchet switch positioned in the cylinder, a ratchet spring of the ratchet switch extending into the interior space.

5. The electrical overload protection device of claim 4, further including:

the button being cup shaped and translucent; and an illumination module positioned between the reset spring and the bracket, the illumination module being in electrical contact with that the reset spring, such that the illumination module is powered when the terminal segment is in electrical contact with the bimetal strip, wherein illumination module is configured for illuminating the button upon depressing of the button until the bimetal strip is exposed to the specified current.

6. The electrical overload protection device of claim 4, further including a cutout positioned in the bimetal strip defining an extension, the extension extending angularly from the bimetal strip over the cutout, such that the extension is positioned for contacting the ratchet spring.

7. The electrical overload protection device of claim 6, further including:

a first connecting element attached to the housing and the plate spring;

a second connecting element attached to the housing and a first edge of the bimetal strip; and a plurality of connectors, each connector being attached to a respective one of the first connecting element, the second connecting element, the ratchet spring, and the extension, for enhancing electric connections therebetween.

8. The electrical overload protection device of claim 6, further including:

a pipe attached to and extending from the upper facet of the housing, the pipe being in fluidic communication with the interior space; and the shaft being positioned in the pipe, such that an upper end of the shaft is substantially flush with a top of the pipe when the shaft is in the depressed position.

9. The electrical overload protection device of claim 6, wherein the shaft is brightly colored, such that the shaft is readily visible when in the extended position.

10. The electrical overload protection device of claim 1, wherein the bimetal strip comprises a bottom layer and a top layer, the bottom layer and the top layer comprising active metal and passive metal, respectively, such that the bimetal strip bends from the bottom layer to the top layer.

11. The electrical overload protection device of claim 1, further including a wedge attached to a bottom of the housing and extending into the interior space, such that the wedge contacts the bimetal strip for enhancing electrical contact between the bimetal strip and the biaser.

12. The electrical overload protection device of claim 1, wherein the illumination module comprises a printed circuit board and a light emitting diode.

13. A method of protecting an electronic device from damage due to an electrical overload, the method comprising the steps of:

providing an electrical overload protection device comprising:

a housing defining an interior space, a button attached to an upper facet of the using; the button being selectively depressible, a biaser attached to the housing and operationally engaged to the button, such that the biaser selectively retains the button in a depressed configuration and an extended configuration, a shaft slidably attached to the housing and selectively extendible from the upper facet of the housing, such that the shaft is selectively positionable in a depressed position and an extended position, a plate spring having a first end attached to the housing and a second end attached to the biaser, and a bimetal strip attached to the housing and positioned in the interior space, the bimetal strip is reversibly deformable and configured for bending upon exposure to a specified current, wherein the button is configured for depressing for inducing electrical contact of the biaser with the bimetal strip for completing an electrical circuit, such that, upon exposure to the specified current, the bimetal strip bends and actuates the plate spring for extending the shaft from the upper facet and for disengaging the biaser from the bimetal strip for breaking the electrical circuit, positioning a user for depressing the shaft for reversing deformation of the bimetal strip and far actuating the biaser for extending the button to the extended configuration, such that the button is again depressible for completing the electrical circuit;

operationally inserting the electrical overload protection device into an electrical circuit comprising an electrical device;

depressing the button to complete the electrical circuit to power the electronic device;

monitoring the electrical overload protection device for rising of the shaft from the pipe;

depressing the shaft; and depressing the button to reestablish the electrical circuit and to resupply power to the electronic device.

* * * * *